US007426957B2

(12) United States Patent
Hendrix et al.

(10) Patent No.: US 7,426,957 B2
(45) Date of Patent: Sep. 23, 2008

(54) STACKED PLATE-TYPE HEAT EXCHANGER

(75) Inventors: Daniel Hendrix, Stuttgart (DE); Florian Moldovan, Stuttgart (DE)

(73) Assignee: BEHR GmbH & Co. KG, Stuttgart (DE)

( * ) Notice: Subject to any disclaimer, the term of this patent is extended or adjusted under 35 U.S.C. 154(b) by 447 days.

(21) Appl. No.: 10/518,708

(22) PCT Filed: Jun. 23, 2003

(86) PCT No.: PCT/EP03/06579

§ 371 (c)(1),
(2), (4) Date: Dec. 22, 2004

(87) PCT Pub. No.: WO04/001315

PCT Pub. Date: Dec. 31, 2003

(65) Prior Publication Data

US 2005/0241814 A1 Nov. 3, 2005

(30) Foreign Application Priority Data

Jun. 25, 2002 (DE) ..... 102 28 263

(51) Int. Cl.
*F28F 3/00* (2006.01)

(52) U.S. Cl. ..... 165/166; 165/167; 165/916

(58) Field of Classification Search ..... 165/166, 165/167, 916

See application file for complete search history.

(56) References Cited

U.S. PATENT DOCUMENTS 2,623,736 A * 12/1952 Hytte ..... 165/100
3,372,744 A * 3/1968 Skoog ..... 165/167
4,098,330 A * 7/1978 Flower et al. ..... 165/166
4,911,235 A * 3/1990 Andersson et al. ..... 165/167
5,099,912 A * 3/1992 Tajima et al. ..... 165/133
5,165,468 A * 11/1992 Tajima et al. ..... 165/47
5,291,945 A 3/1994 Blomgren et al.
5,464,056 A * 11/1995 Tajima et al. ..... 165/167
5,511,612 A * 4/1996 Tajima et al. ..... 165/167

(Continued)

FOREIGN PATENT DOCUMENTS

DE 43 14 808 A1 11/1994

(Continued)

*Primary Examiner*—Leonard R Leo
(74) *Attorney, Agent, or Firm*—Foley & Lardner LLP

(57) ABSTRACT

The invention relates to a stacked panel-shaped heat transmitter comprising a plurality of interstacked trough-shaped panels (23,24) of a first and second type forming therebetween flow channels (25,26) for a first medium at a first height h and for a second medium at a second height H. The panels (23,24) have erect peripheral edges which are soldered to each other, the height thereof being different for the first and second type of panel. According to the invention, the first type of panel (23) has an edge (23*a*) corresponding to height h1 and a flank angle A. The second type of panel (24) has a higher edge which consists of at least three sections (24*a*, 24*b*, 24*c*), the height thereof being H1, H2 and H3. The first edge section (24*a*) corresponding to a height H1 and the third edge section (24*c*) corresponding to a height H3 respectively have a flank angle α. The second edge section (24*b*) corresponding to height H2 extends vertically in relation to the base of the panel (24*e*).

6 Claims, 2 Drawing Sheets

U.S. PATENT DOCUMENTS

| | | | | |
|---|---|---|---|---|
| 5,931,219 | A | 8/1999 | Kull et al. | |
| 6,182,746 | B1 | 2/2001 | Wiese | |
| 6,814,133 | B2 * | 11/2004 | Yamaguchi | 165/41 |

FOREIGN PATENT DOCUMENTS

| | | | | |
|---|---|---|---|---|
| DE | 691 06 354 | T2 | | 5/1995 |
| DE | 19517174 | C | * | 6/1996 |
| DE | 195 19 312 | A1 | | 11/1996 |
| DE | 197 50 748 | A1 | | 7/1999 |
| EP | 0 551 545 | B1 | | 7/1993 |
| EP | 0 742 418 | B1 | | 11/1996 |
| EP | 1063487 | A1 | * | 12/2000 |
| WO | WO 97/15797 | | | 5/1997 |

* cited by examiner

STACKED PLATE-TYPE HEAT EXCHANGER

CROSS-REFERENCE TO RELATED APPLICATIONS

This application is a national phase application under 35 U.S.C. 371 of PCT/EP03/06579, filed Jun. 23, 2003, and claims the benefit of German application 102 28 263.3, filed Jun. 25, 2002.

TECHNICAL FIELD OF THE INVENTION

The invention relates to a stacked plate-type heat exchanger as known from DE-A 195 11 991 from the same applicant.

BACKGROUND ART

Stacked plate-type heat exchangers are known, for example- from DE-A 43 14 808 and DE-A 197 50 748, in each case from the same applicant. This known heat exchanger type in principle uses the same identical plates of single type, in order to achieve a large number of identical parts. This results in the same channel height for the media involved in the exchange of heat, for example oil and coolant, that is the say the same flow cross section. The different heat transfer conditions for the different media can be counteracted by means of different, that is to say matched, turbulence inserts between the plates.

In the case of highly different media, for example liquid and gaseous media, flow channels with a different cross section are required for efficient heat transfer. Two solutions for a stacked plate-type heat exchanger have therefore been proposed in DE-A 195 11 991 from the same applicant, in which a smaller channel cross section is provided for a first medium, for example a coolant in a coolant circuit of an internal combustion engine, than for a second medium, for example the boost air, which has been compressed and heated by a compressor, for the internal combustion engine. In the first solution, only identical plates with the same channel height are used, although two or more channels are connected to be parallel on the boost air side, so that twice the flow cross section, or two or more times the flow cross section is available for the boost air in comparison to the flow cross section for the coolant. According to the second solution, different plate types are used, for example of two types, so that the flow channels through which the boost air flows have approximately twice the channel height of the coolant channels. The two different plate types have rims which are raised at right angles with respect to the plate base and are provided with a step, with the circumferential steps acting as a rest and stop surface for adjacent plates when these plates are stacked. The plate rims are soldered to one another in overlapping, vertically raised areas, for which purpose a defined gap that is subject to relatively narrow tolerances is required, otherwise the soldering is not leakproof. To this extent, this design is characterized by increased manufacturing effort and increased costs.

SUMMARY OF THE INVENTION

The object of the present invention is to improve a plate-type heat exchanger of the type mentioned initially such that it can be produced with less manufacturing effort and at lower cost.

First of all, the rims of both the first plate type and of the second plate type are arranged inclined with respect to the plate base, that is to say with a flank angle $\alpha$ which allows the plates to be stacked easily. Manufacturing inaccuracies can be compensated for by elastic deformation owing to the conical nature of the rims or flanks. The rim formation of the second plate type according to the invention results in a flow channel with a larger channel height. This is achieved by the rim area of the second plate type having a first and a third flank section as well as a central or second section which runs at right angles to the plate base and which governs the channel height. The plates are produced by deep drawing or thermoforming in a number of steps, and the manufacturing effort is therefore relatively low.

According to one advantageous development of the invention, the plates of the first and of the second type are stacked in an alternating sequence, so that one channel with a small height in each case alternates with a channel with a greater height. However, other sequences are also possible, for example two or more channels to which a flow medium is applied in parallel.

According to one advantageous development of the invention, the rim of the first plate type has an insertion flank with a larger flank angle than the flank section which is adjacent to the plate base. This makes it easier to insert the next plates during the stacking process, that is to say it simplifies the assembly process. Furthermore, this insertion flank results in the rim areas being soldered better.

According to a further advantageous refinement of the invention, the second plate type is also provided-with an insertion flank, which likewise results in the already mentioned advantageous of an improved assembly and soldering.

According to one advantageous refinement of the invention, means for production of vortices, for example turbulence inserts or turbulence plates, studs, beads, etc. are arranged between the plates, and are soldered to them, in the flow channels. This results in improved heat transfer by forming vortices in the media, and in the plate stack being more resistant to pressure. The pressure drop and the geometric shape of the turbulence inserts can be matched to the different media, such as coolant and boost air. The heights of the turbulence inserts define the distance between the plates, and thus the channel height.

BRIEF DESCRIPTION OF THE DRAWINGS

One exemplary embodiment of the invention is illustrated in the drawing and will be described in more detail in the following text. In the figures.

DETAILED DESCRIPTION OF PREFERRED EMBODIMENTS

Figure 1:
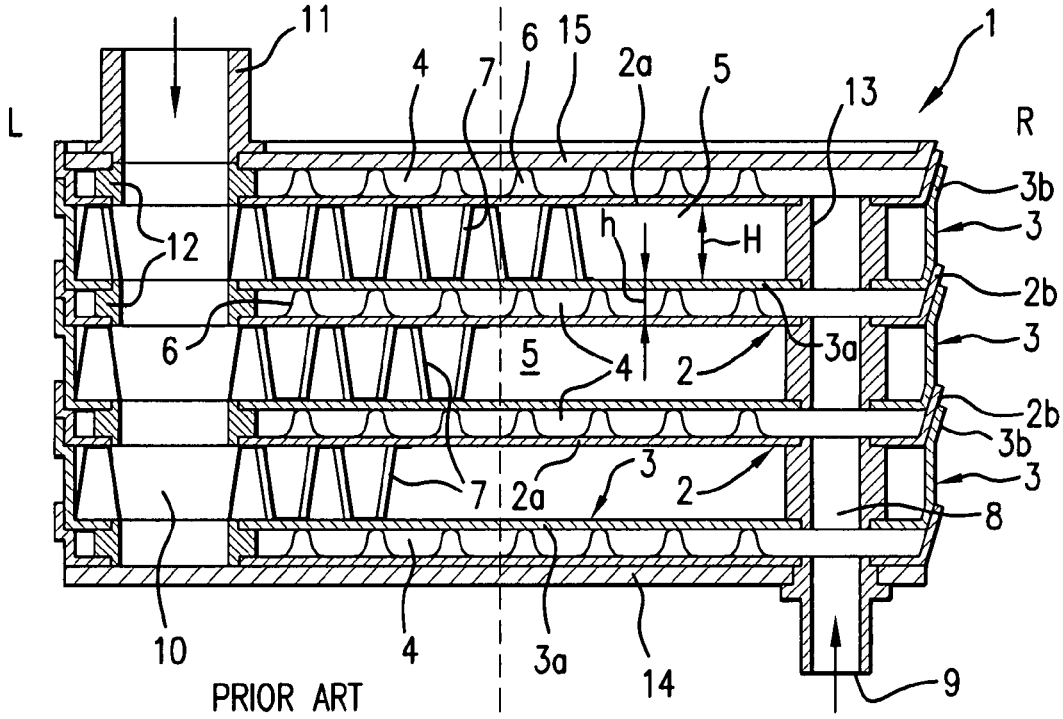
FIG. 1 shows a section on the plane I-I as shown in FIG. 2 through a stacked plate-type heat exchanger according to the prior art (left half) and according to the invention (right half)

FIG. 1 shows a section along the plane I-I (FIG. 2) through a plate-type heat exchanger 1, the left side L of which figure shows an embodiment according to the prior art from DE-A 195 11 991 from the same applicant, and whose right half R shows the embodiment of the plate-type heat exchanger according to the invention. This comprises two different plate types, specifically a plate 2 of less height and a plate 3 of greater height. Both plate types 2, 3 each have a flat base 2*a*, 3*a* and a raised rim 2*b*, 3*b*, whose geometric configuration will be explained in more detail below. The plates 2, 3 are stacked one on top of the other in a known manner and form flow channels 4 of height h and flow channels 5 of height H, that is to say with a different channel height (H>h). In the illustrated exemplary embodiment, turbulence inserts 6, 7 are arranged within the flow channels 4, 5, for filling the channel cross section and are soldered to the adjacent plate bases 2*a*, 3*a*. The flow channels 4 are connected to a distribution channel 8, which is arranged such that it is aligned with an inlet connecting stub 9 for a first medium. The flow channels 5 with the greater channel height H are connected to a distribution channel 10, which is arranged such that it is aligned with an inlet connecting stub 11 for a second medium. The first medium, which enters the plate-type heat exchanger 1 through the inlet connecting stub 9, is a coolant in a coolant circuit (which is not illustrated) for an internal combustion engine in a motor vehicle, while the second medium, which enters the plate-type heat exchanger 1 through the inlet connecting stub 11, is boost air which has been compressed by a compressor (which is not illustrated) and has thus been heated, and which is cooled by the coolant in this plate-type heat exchanger and is then passed to the internal combustion engine, which is not illustrated. The further components of this plate-type heat exchanger such as annular spaces 12 and 13 of different height for the low flow channels 4 and for the higher flow channels 5, as in the case of a lower closure plate 14 and an upper closure plate 15, correspond to the known prior art.

Figure 2:
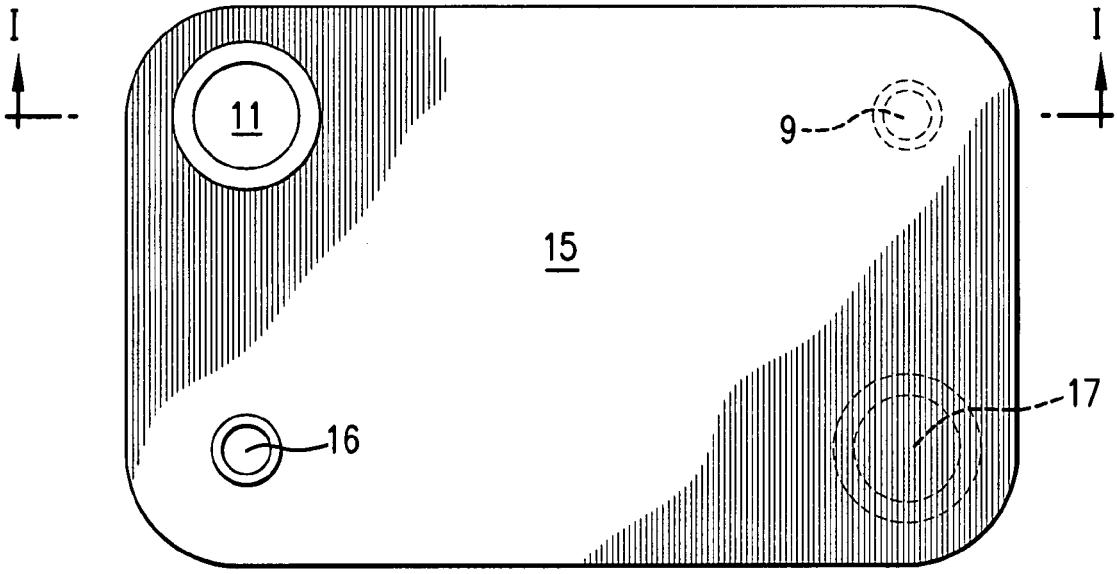
FIG. 2 shows a view from above in the form of a schematic (incomplete) illustration of the plate-type heat exchanger.

FIG. 2 shows a view of the plate-type heat exchanger 1 as shown in FIG. 1 from above, looking at the boost air inlet connecting stub 11—the coolant inlet connecting stub 9 is concealed, and is thus represented by dashed lines. Furthermore, a coolant outlet connecting stub 16 is arranged on the upper closure plate 15, while a boost air outlet connecting stub 17 is represented by dashed lines (because it is concealed). The boost air thus flows on the one hand diagonally from the inlet connecting stub 11 through the flow channels 5 to the outlet connecting stub 17, and on the other hand from above downwards through the plate-type heat exchanger 1. In contrast, the coolant likewise flows diagonally from the inlet connecting stub 9 through the flow channels 4 to the outlet connecting stub 16, but from the bottom upwards. Other flow forms are possible according to the cited prior art.

All parts of the illustrated plate-type heat exchanger 1 are preferably composed of an aluminum alloy, are plated with solder and are soldered with one another, as are the conical rim areas 2*b* with the rim areas 3*b*, as well. The conicity of these rim areas 2*b*, 3*b* is described in more detail in the following text.

Figure 3:
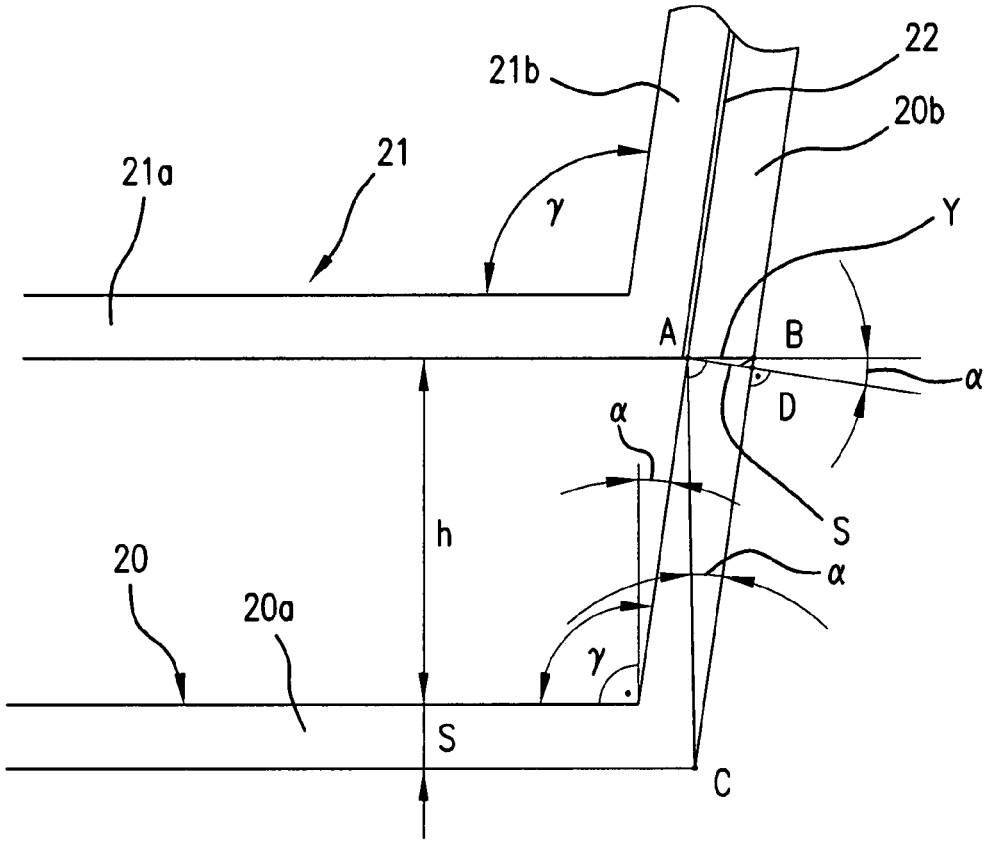
FIG. 3 shows a sketch relating to the calculation of the flank angle a of the plate rims.

FIG. 3 shows a sketch with a first plate 20 and a second plate 21, which are stacked one inside the other. The plates 20, 21 each have a flat base 20*a*, 21*a* as well as circumferential rim areas 20*b*, 21*b*, which are raised obliquely and are inclined at an obtuse angle $\gamma$ to the base 20*a*, 21*a*. The obtuse angle $\gamma$ is in this case composed of the sum of 90° plus an angle $\alpha$. The plates 20, 21 each have a wall thickness s in the base and rim area, and the channel height between the plates 20, 21 is indicated by h. The intersections of the lines A, B, C which are shown as well as the inter-sections A, C, D in each case form right-angled triangles. The distance A-C comprises the sum of s plus h, while the distance A-D corresponds to the wall thickness s. This results in the following angle relationship: $\sin \alpha = s/(s+h)$; the so-called flank angle $\alpha$ thus results from the choice of the wall thickness s and the channel height h.

The condition in this case is that the point A is vertically above the point C. When the panels 20, 21 are stacked, this results in a contact surface 22 between the outer surface of the rim area 21*b* and the inner surface of the rim area 20*b*. The panels are soldered to one another in this contact area 22.

Figure 4:
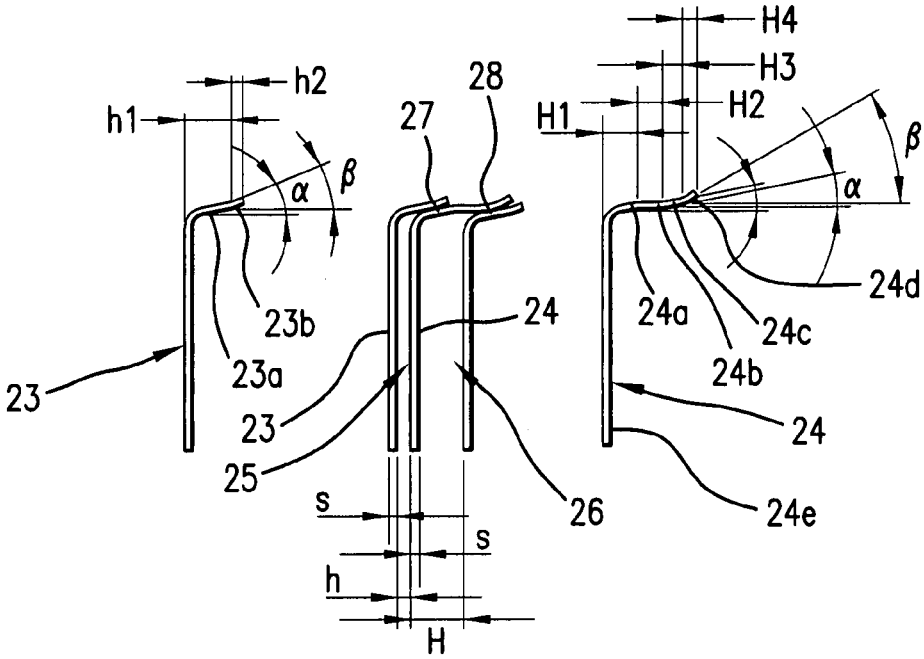
FIG. 4 shows a schematic illustration of the rim areas of a first and of a second plate type according to the invention.

FIG. 4 shows a schematic sketch of the two plate types, that is to say a plate 23 of the first type, shown individually on the left-hand side and a plate 24 of the second type, shown individually on the right-hand side; the assembly formed by the two plates 23, 24 is illustrated in the center of FIG. 4, resulting in a flow channel 25 of height h (for the coolant) and a flow channel 26 of height H (for the boost air). The illustration shows H>h; with the plates being chosen such that the ratio of the channel height H to the channel height h is in the range from 1.5 to 10, preferably in the range between 2 and 6. The plates 23, 24 correspond to the plates 2, 3 in FIG. 1.

The plate 23, part of which is illustrated individually on the left, has a circumferential first rim section 23*a* with a height h1 and a flank angle $\alpha$. Adjacent to this first section 23*a* there is a second section 23*b* of height h2 with a flank angle $\beta$, where $\beta > \alpha$. This second section 23*b* forms a so-called insertion flank, owing to the larger angle $\beta$.

The plate 24 of the second type is shown individually on the right-hand side of FIG. 4; this has a plate base 24*e* and four sections which are adjacent to one another, to be precise a first section 24*a* of height H1 with a flank angle $\alpha$, a second section 24*b* of height H2 with a flank angle of 0°, a third section 24*c* of height H3 with a flank angle $\alpha$, and a fourth section 24*d* of height H4 with a flank insertion angle $\beta$. The second section 24*b* is thus not inclined, but runs at right angles to the plate base 24*e*.

This geometry of the plate 23, 24, that is to say of their rim area 23*a*, 23*b* and 24*a* to 24*d*, results, during stacking of these plates, in the illustration shown in the center of FIG. 4, with different channel heights h and H for the coolant channel 25 and for the boost air channel 26. The conical rim areas, that is to say the flanks inclined at the angle $\alpha$ of the plates 23, 24 are parallel to one another in the areas 27, 28, and are soldered in these areas. The respectively adjacent insertion flank areas 23*b* and 24*d* are used to simplify assembly and at the same time lead to better soldering, because the soldered gap is wider. The channel height H can be varied by varying the height H2 of the second section 24*b*.

The invention claimed is:

1. A stack plate-type heat exchanger, comprising a large number of plates which are in the form of troughs and are stacked one inside the other, of a first and of a second type, which, between them, form flow channels with a first height h for a first medium and with a second height H for a second medium, with the plates having rims which are raised on the circumference, are soldered to one another and have different heights for the first and for the second plate type, wherein the first plate type has a rim of height h1 with a flank angle $\alpha$, and the second plate type has a higher rim which is composed of at least three sections of height H1, H2 and H3, with the first rim section whose height is H1 and the third rim section whose height is H3 each having a flank angle $\alpha$, while the second rim section whose height is H2 runs at right angles to the plate base.

2. The plate-type heat exchanger as claimed in claim 1, wherein the plates of the first and of the second type are stacked alternately, so that adjacent flow channels have different channel heights h, H.

3. The plate-type heat exchanger as claimed in claim 1, wherein the ratio of the channel height H to the channel height h is in the range from 1.5 to 10.

4. The plate-type heat exchanger as claimed in claim 1, wherein a second section with an insertion flank, a flank angle β and a height h2 is adjacent to the first rim section of the first plate type, where $\beta > \alpha$.

5. The plate-type heat exchanger as claimed in claim 1, wherein a fourth section with an insertion flank, a flank angle β and a height H4 is adjacent to the third rim section of the second plate type.

6. The plate-type heat exchanger as claimed in claim 1, wherein means for production of vortices are arranged between the plates and in the area of the flow channels.

* * * * *